United States Patent [19]

Schroeder

[11] 3,951,066

[45] Apr. 20, 1976

[54] INCENDIARY FRAGMENTATION DEVICE

[75] Inventor: Fred Schroeder, Lakeview Terrace, Calif.

[73] Assignee: Dow Corning Corporation, Midland, Mich.

[22] Filed: July 11, 1974

[21] Appl. No.: 487,477

[52] U.S. Cl. ..... 102/65; 102/6; 102/66; 102/68; 102/90

[51] Int. Cl.[2] ..... F42B 27/04

[58] Field of Search ..... 102/6, 65, 66, 68, 90; 149/19.1, 19.2, 19.3

[56] References Cited

UNITED STATES PATENTS

| | | | |
|---|---|---|---|
| 2,949,352 | 8/1960 | Cramer | 149/19.2 |
| 3,411,964 | 11/1968 | Douda | 149/19.2 |
| 3,669,020 | 6/1972 | Waite et al. | 149/19.3 |

FOREIGN PATENTS OR APPLICATIONS

| | | | |
|---|---|---|---|
| 560,822 | 4/1957 | Italy | 102/66 |

*Primary Examiner*—Verlin R. Pendegrass
*Attorney, Agent, or Firm*—Howard W. Hermann

[57] ABSTRACT

An incendiary fragmentation device such as artillery round, bomb, or grenade, in which a high explosive charge within a casing has imbedded therein a hollow cylindrical body of frangible incendiary material which is ignited by detonation of the high explosive. The frangible incendiary material is a mixture of silicone rubber, powdered magnesium, and an oxidizing agent.

2 Claims, 4 Drawing Figures

INCENDIARY FRAGMENTATION DEVICE

BACKGROUND OF THE INVENTION

The present invention relates to incendiary devices which are designed to ignite combustible material and are dispersed by means of an explosive charge. Such devices have both military use in the destruction of property and war materiel and civilian application, for example, in starting backfires for forest fire control.

Several types of incendiary devices of the general type contemplated by the present invention have been used in the past. One common type has used a pelleted flowing, powdery mixture of metal and oxidizer which is dispersed upon explosion of an explosive charge. Such devices, of course, inherently have an obvious hazard insofar as handling is concerned because the materials are spontaneously reactable. Further, they are not totally satisfactory because the pellets tend to disintegrate and burn too rapidly or to detonate themselves. The explosive charge tends to disperse the powders in an erratic manner. Thus, neither uniformity nor extent of distribution is often optimum.

Another type of known device makes use of fragments of solid compositions such as zirconium-misch metal, or Thermits. These materials can be cast into a proper form such as the lining of a shell casing which is then filled with the explosive charge. They tend to suffer, however, from handling difficulties due to vacuums and pressures needed for fabrication and to early burn-out and failure to ignite ambient combustible material. Further these materials are brittle and tend to disintegrate into extremely fine particles upon exposure to the pressures of detonation resulting in a quick burning powder. Misch metal and zirconium require outside oxygen for burning and thus are ineffective under water or other liquids or at high altitudes where oxygen is scarce.

SUMMARY OF THE PRESENT INVENTION

It is, therefore, an object of the present invention to provide a new incendiary device which eliminates the shortcomings mentioned above in connection with the prior art. There is provided according to the present invention an incendiary fragmentation device comprising a casing enclosing a quantity of high explosive charge, detonating means in the casing for detonation of the high explosive charge, and a hollow cylindrical body of frangible but not detonatable incendiary material imbedded in the high explosive charge.

The incendiary material is capable of ignition upon detonation of the high explosive charge and is preferably surrounded inside and out by the high explosive material. As the high explosive detonates and the casing ruptures a differential pressure builds up between the inside and outside of the cylinder causing fragmentation of the incendiary material but full ignition thereof so that burn-out is effectively prevented. The greater pressure inside as the casing ruptures also disperses the particles in a relatively flat pattern parallel to the ground due to the cylindrical configuration. This results in maximum ignition of ambient combustibles over a wide range with a minimum of wasted incendiary material.

The incendiary material is made up of a mixture of magnesium powder and oxidizer in a silicone rubber binder as described in my copending application Ser. No. 487,474, filed concurrently herewith and entitled "Incendiary Composition." The silicone rubber serves to isolate the magnesium powder from the oxidizer thus providing safety in handling and also provides a supply of oxygen to the magnesium so that the system is not dependent upon ambient air for an oxygen source for burning.

If desired, the cylinder may be formed of a stack of toroidal shaped pieces instead of being an integral cylinder. In such case the dimensions of the stack govern the properties which are necessary for proper fragmentation of the incendiary.

BRIEF DESCRIPTION OF THE DRAWINGS

Other objects and attendant advantages of the present invention will become known to those skilled in the art from a reading of the following detailed description in connection with the accompanying drawings wherein.

DESCRIPTION OF PREFERRED EMBODIMENTS

Figure 1:
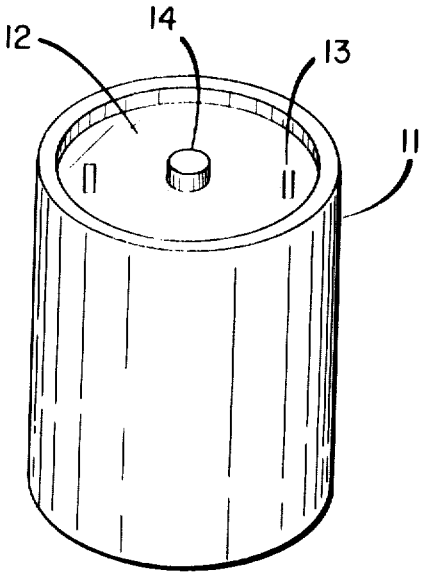
FIG. 1 is a view in perspective of a grenade made in accordance with the present invention.
Figure 2:
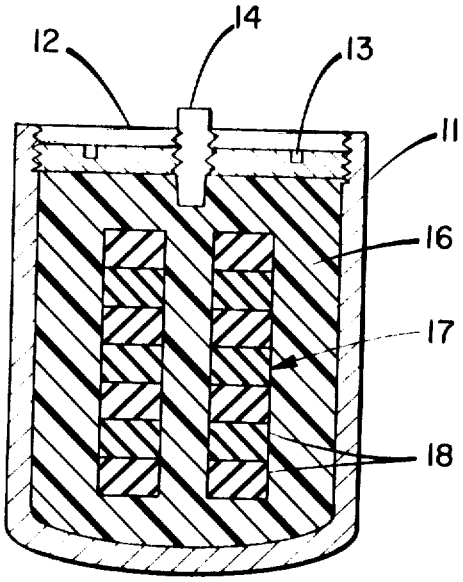
FIG. 2 is a cross-section of the grenade of FIG. 1.

Referring now to the drawings wherein like reference characters designate like or corresponding parts throughout the figures thereof there is shown in FIG. 1 a grenade having a canister or casing 11 which is closed by means such as a screw top 12 threaded therein to complete the casing. A pair of holes 13 are provided in the top surface of the screw top 12 for cooperation with a suitable spanner wrench to close the casing. There is disposed in the center of the casing, again preferably by means of screw threads, a conventional detonating device 14. As may be seen in FIG. 2 the casing 11 is filled with a high explosive compound of any suitable type such as those based on trinitrotoluene. Various such compositions are well known in the art. Although the invention is described with respect to a grenade it is to be understood that it can be applied to any type of explosive device such as, for example, artillery rounds or air dropped bombs. The method of delivery of the device to a target does not form part of this invention.

Figure 3:
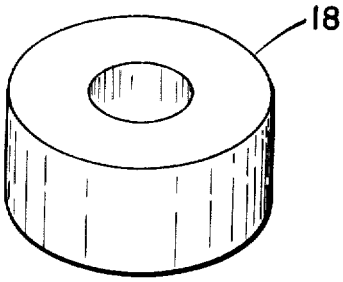
FIG. 3 is a view perspective of a segment of the cylinder shown in the cross-section in FIG. 2.

Imbedded in the high explosive charge 16 is a hollow cylinder of incendiary material shown generally at 17. If desired, the cylinder 17 may be made up of a plurality of toroidal bodies or rings 18 as shown in FIG. 3, to aid in fragmentation. A suitable composition for the cylinder 17 is a cured mixture of 25% by weight room temperature vulcanizing silicone rubber, 25% magnesium powder of 320 U.S. Standard screen mesh particle size and 50% by weight $Fe_3O_4$. A suitable silicone rubber RTV is commercially available under the designation Dow Corning 3110 RTV encapsulant. The magnesium powder is preferably ground rather than spherical thus providing greater surface area. Alternatively, the cylinder may be made of other compositions as described in my aforementioned copending application.

Figure 4:
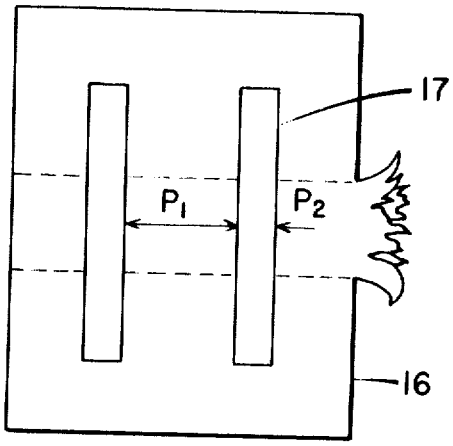
FIG. 4 is a schematic representation of the pressure diagram within the grenade as shown in FIGS. 1–3.

As may be seen most clearly from the diagrammatic view shown in FIG. 4, as the high explosive composition 16 detonates causing pressure differential inside the toroid due to release of pressure outside the toroid as the case ruptures. Upon case rupture, at a given point in time a pressure $P_1$ will be seen on the inside surface of the cylinder and a different pressure $P_2$ will be exerted on the outside surface thereof due to release. The differentials between $P_1$ and $P_2$ cause fragmentation of the cylinder while the highly exothermic detonation ignites the fractured pieces and the sudden release of pressure causes dispersion of the ignited pieces primarily in a relatively flat pattern substantially parallel to the ground.

In the case where the cylinder is composed of silicone rubber, magnesium powder and oxidizer as heretofore described, the composition burns either in air or under water and leaves an ash which tends to act as a wick for combustible fluids such as diesel oil thereby igniting such ambient combustibles. The minimization of pressure differentials by applying pressures both inside and outside of the cylindrical configuration and the use of the elastomeric binder tend to prevent powdering of the incendiary material which might otherwise occur and which would result in very rapid burn-out times. Obviously, for effectiveness burning must continue throughout the trajectory of the fragment and for sufficient time after landing on combustible material to cause it to reach its kindling temperature.

Obviously, modification and variations of the invention herein described will become obvious to those skilled in the art from a reading of the foregoing. Therefore, it is to be understood that within the scope of the appended claims the invention can be practiced otherwise than as specifically described.

That which is claimed is:

1. An incendiary fragmentation device comprising a casing defining an enclosed void, a high explosive charge filling said void, detonating means in said casing for detonation of said high explosive charge, and a hollow cylindrical body having an outside diameter less than the diameter of said void, said body being of frangible incendiary material comprising magnesium powder and an oxidizer in a silicone rubber binder, said body further being capable of ignition by said high explosive charge upon detonation thereof and being disposed in said high explosive charge and having said charge in contact with both the inside and outside walls of said body.

2. An incendiary fragmentation device as defined in claim 1 wherein said cylindrical body is a plurality of stacked toroidal bodies in intimate contact with one another.

* * * * *